United States Patent [19]

Bourdon et al.

[11] 4,258,970

[45] Mar. 31, 1981

[54] ELECTRICAL CABLE AND MOLDED PROTECTION CAP ASSEMBLY

[75] Inventors: Normand C. Bourdon, Unadilla; Donald H. Gould, Sidney, both of N.Y.

[73] Assignee: The Bendix Corporation, Southfield, Mich.

[21] Appl. No.: 17,750

[22] Filed: Mar. 5, 1979

[51] Int. Cl.[3] ..... H01R 13/52

[52] U.S. Cl. ..... 339/38; 339/116 R

[58] Field of Search ..... 339/36, 38, 47 R, 91 R, 339/49 R, 116 R, 116 C, 94 C, 94 M, 40 C; 285/DIG. 2

[56] References Cited

U.S. PATENT DOCUMENTS

| | | | |
|---|---|---|---|
| 1,978,510 | 10/1934 | Spence | 339/36 |
| 2,428,323 | 9/1947 | Winer | 339/38 X |
| 2,962,688 | 11/1960 | Werner | 339/94 M X |
| 3,129,993 | 4/1964 | Ross | 285/DIG. 2 X |
| 3,387,252 | 6/1968 | Rothweiler | 339/38 |
| 3,725,845 | 4/1973 | Moulin | 339/49 R |

FOREIGN PATENT DOCUMENTS

| | | | |
|---|---|---|---|
| 2329466 | 12/1974 | Fed. Rep. of Germany | 339/36 |
| 2360189 | 3/1978 | France | 339/36 |

*Primary Examiner*—Eugene F. Desmond
*Attorney, Agent, or Firm*—K. A. Seaman; R. J. Eifler

[57] ABSTRACT

An electrical cable assembly having a connector termination with electrical contacts mounted therein and a molded protection cap for releasably fitting on the end of the connector to insulate and protect the contacts from damage or moisture. The connector includes a pair of two-terminal contacts mounted within a housing which includes forwardly projecting semi-circular ring elements and radially opposed projecting coupling lugs. The protection cap includes a one-piece body of a molded polymeric substance (preferably a Zytel nylon plastic) which body includes an outer wall and recesses for receiving the ring elements. The cap also includes a pair of cavities which are positioned to receive the individual two-terminal contacts of the electrical connector when the cap is fitted in place on the connector. The outer periphery of the body wall includes means for guiding the coupling lugs from the contact into a latch which is radially movable to releasably retain the lugs therein to prevent accidental separation therefrom. The lugs each include a lip and the latch has projections which latch behind the lip to provide a positive lock until released. The cap additionally includes sealing grommets in the regions of the semi-circular ring elements and the contact-receiving cavities.

5 Claims, 8 Drawing Figures

(METAL)

FIG. 5
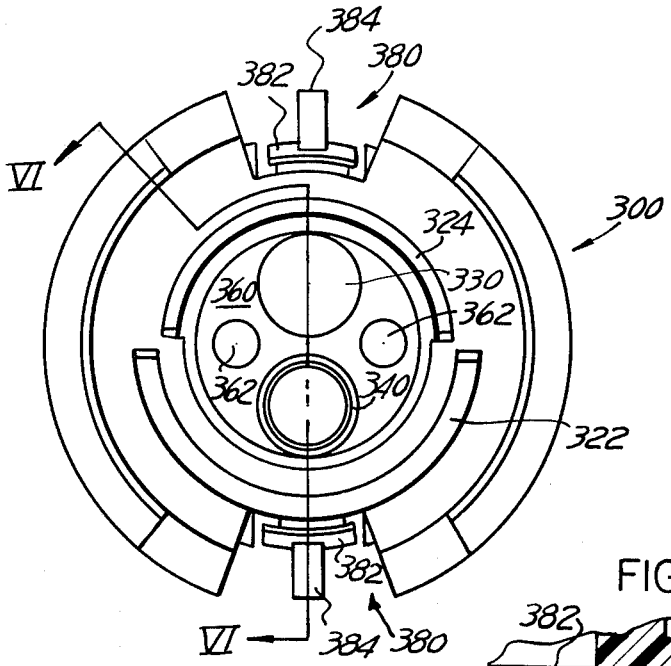
FIG. 7
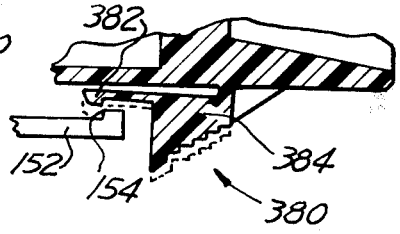
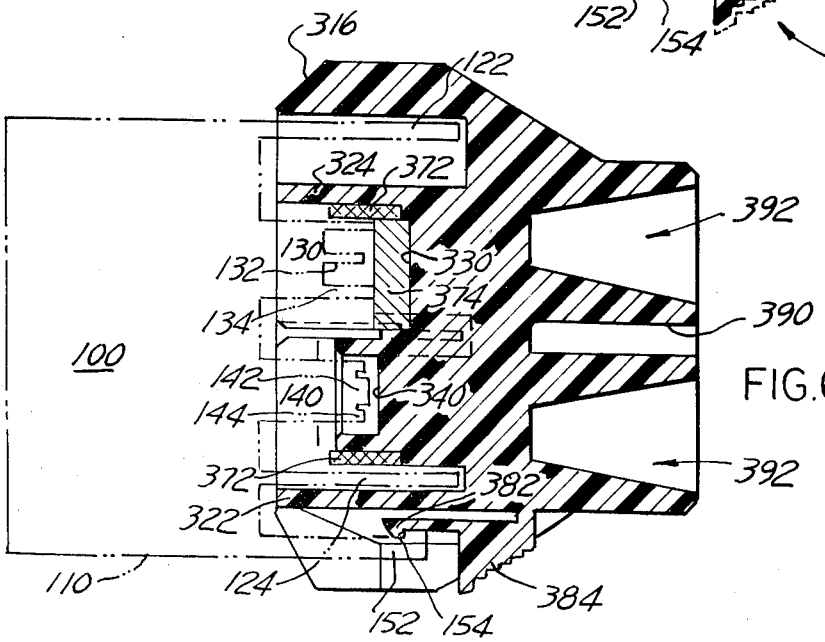
FIG. 6

ELECTRICAL CABLE AND MOLDED PROTECTION CAP ASSEMBLY

FIELD OF THE INVENTION

The present invention relates to electrical cable assemblies. More particularly, the present invention relates to a protection cap for the cable and electrical contacts mounted within a connector on the cable. Preferably, the protection cap is molded from polymeric (plastic) material.

BACKGROUND OF THE INVENTION

The present invention is a cable assembly, and more particularly a twin axial cable and connector assembly of the type which the Federal Government has designated under the performance requirements UG/187-0/U. Such a cable has been in existence for some time and requires a protection cap for mounting thereon when the cable is not interconnected with another cable of similar design.

The known protection caps presently in use for this connector application are metallic caps which have numerous disadvantages. The greatest disadvantage, perhaps, is that the cap has a relatively high cost. The cost results from the required die casting and subsequent machining into a rather complicated final shape. Additionally, if a lanyard is desired to couple the cap to a cable when the cap if not mated to the connector, it must be separatly manufactured from another material and assembled thereon.

The present metallic protection cap also has a disadvantage that it is a relatively heavy part in its weight as a metal part.

The present cap also has the disadvantage that it does not make a positive lock to resist subsequent movement and consequently, the cap may be disassociated with the cable assembly and connector in use through vibration and movement forces which would tend to decouple the connector from the cap.

The present cap also is not impervious to moisture. Moisture has an undesirable effect on the life of a connector and the reliability of circuits which are subsequently made after moisture exposure.

The cap of the prior art has the further disadvantage that the mating of it with the cable requires an axial movement first to partially assemble the cap and connector, followed by an appropriate amount of rotational movement while maintaining axial alignment of the connector with respect to the cap. A failure to provide either the necessary axial movement or a sufficient amount of rotational movement will leave the cap and the connector improperly coupled and susceptible to easily becoming accidentally decoupled.

The foregoing and other limitations and disadvantages of the prior art caps for protecting such electrical cables will be apparent in view of the following description of the present invention.

SUMMARY OF THE INVENTION

The present invention is a protection cap which is lightweight, easy and inexpensive to manufacture and which provides a positive lock against accidental decoupling. The present cap also has the advantage that it is moisture proof when properly secured to the connector and is secured to the connector and cable with a single axial movement.

The present invention is a cable assembly including a molded protection cap. The protection cap includes a one-piece body of molded polymeric material which includes suitable recesses in the body to receive orienting and locating structures of the cable and connector assembly. The cap also includes appropriate cavities for receiving the two-terminal contacts mounted with the cable and connector assembly. Appropriate gasketing material is provided within the recesses of the cap and within the cavities to assure a moisture-proof seal therebetween and to better seal the unit.

Since the present cap contemplates using a thermosetting or thermoplastic polymeric material, if a lanyard is desired, it may be possible to mold it from the same material at the same time and in the same mold. This would provide an essentially "no cost" lanyard in place of the added expense lanyard in the present design.

The foregoing and other advantages and objects of the present invention will be apparent to one skilled in the art in view of the following detailed description and claims and the appended drawings.

BRIEF DESCRIPTION OF THE DRAWINGS

FIG. 5 is an end view of the cap of FIG. 4, from the line V—V in FIG. 4, looking in the direction of the arrows.

FIG. 6 is a partial cross-sectional view taken along the line VI—VI in FIG. 5, looking in the direction of the arrows. The connector portion of the cable assembly have been added in dotted lines in FIG. 6.

FIG. 7 is an enlarged view of the latch assembly of FIG. 6.

DETAILED DESCRIPTION OF THE DRAWINGS

Figure 1:
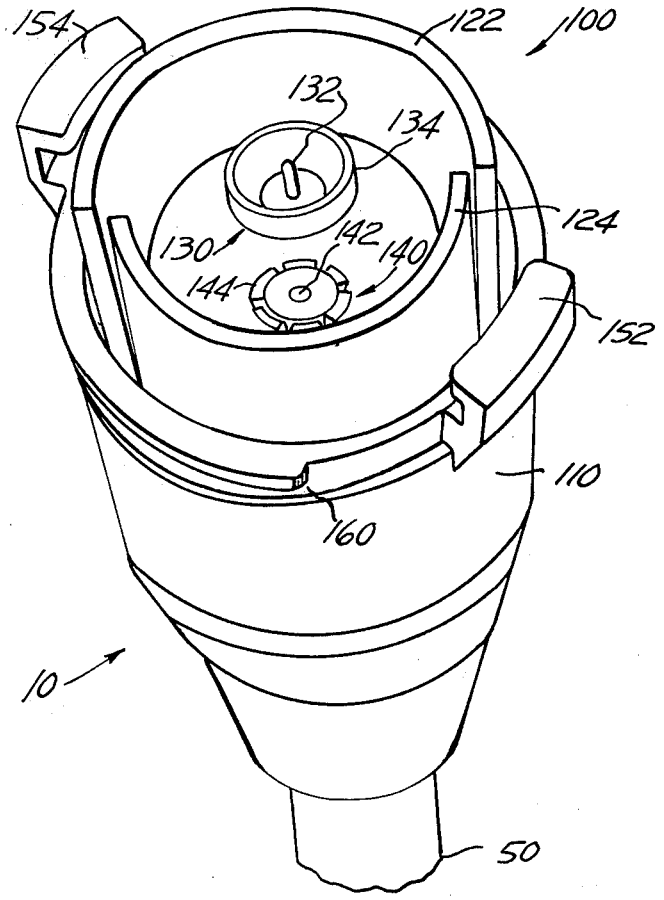
FIG. 1 is a perspective view of a cable and connector assembly which the protection cap is designed to protect.

FIG. 1 is a perspective view of a cable assembly 10 with a connector as is contemplated for use in the assembly of the present invention. A cable termination or connector 100 is shown on the end of a cable 50 which preferably includes two coaxial conductors thereon.

The connector 100 includes a body 110 and forward semi-circular ring shaped wall portions 122, 124. The semi-circular rings 122, 124 extend forwardly of contacts 130, 140 to protect the contacts. The semi-circular rings 122, 124 also serve as orienting elements when the connector mates either with a second identical connector or a protection cap as shown in the prior art or shown in the caps of the present invention.

The connector 100 is hermaphroditic in that it will mate with an identical connector. The semi-circular ring shaped wall portion 122 has a larger diameter than the ring shaped wall portion 124. In mating with a second connector, the smaller ring portion of the second connector (e.g., corresponding to 124) fits within the larger semi-circular ring shaped portion 122 of the illustrated connector. The larger ring shaped portion of the second connector (e.g., corresponding to 122) fits around and outside of the smaller ring shaped element 124 of the illustrated connector.

The contacts 130, 140 each include a pair of terminals as a termination of one coaxial conductor. Thus, the contact 130 includes the terminals 132, 134 and the contact 140 includes terminals 142, 144. Each contact is thus a termination of a single coaxial line and the present arrangement of two coaxial lines in a single cable and termination has been commonly referred to in the trade as a twin axial cable.

The body 110 is provided with locking lugs 152, 154 which extend radially outward from the body and outside of the semi-circular locating rings 122, 124. The lugs 152, 154 are radially opposed and fit within lug receiving recesses 160 which are disposed at radially-opposed locations on the body of the connector. Only one of the two recesses 160 is shown in this view.

Figure 2:
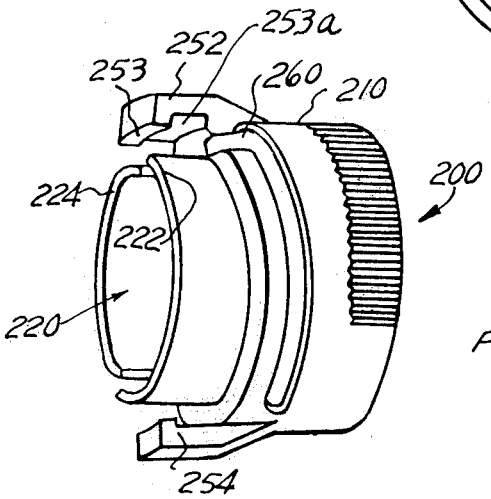
FIG. 2 PRIOR ART
FIG. 2 is a perspective view of the prior art protection cap.

FIG. 2 shows a perspective view of the prior art (metallic) protection cap. This protection cap is formed in a single piece or two pieces by an initial die casting process and is subsequently machined to obtain the necessary detail work.

The prior art metal cap 200 has a body 210 and a forward socket 220. The forward socket 220 is defined by a larger semi-circular ring 222 and a smaller diameter semi-circular ring 224. The semi-circular rings 222, 224 correspond to the semi-circular rings 122, 124 in FIG. 1 on the cable and contact region. Locating and locking lugs 252, 254 are disposed at radially separated locations on the periphery of the body 210 and extend forwardly toward the mating face of the cap 200.

Lug receiving recesses 260 are provided on the periphery of the body 200 for receiving the lugs (such as 152, 154). Since the lugs 252 include a forward lip 253 and undercut 253*a*, and since the lug receiving recesses 260 are fairly complicated, the casting and machining process for the metallic protection cap shown in FIG. 2 is rather expensive and time consuming.

Figure 3:
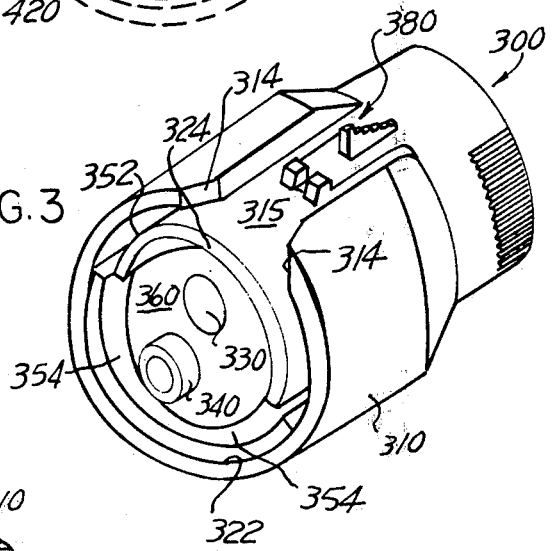
FIG. 3 is a perspective view of the molded plastic cap included in the present invention.

FIG. 3 shows a protection cap as contemplated by the present invention. The protection cap 300 is preferably a molded one-piece body made from a polymeric material such as Zytel nylon plastic, or other suitable plastics which are well known in the art. The body 300 includes a forward wall 310 and semi-circular elements 322, 324. Sockets 330 and 340 are adapted to receive the contacts 130 and 140 when the plastic cap is mated with the connector 100 of FIG. 1.

The outer wall 310 includes a cut out portion 315 and tapering wall portions 314. The cut out portion 315 is adapted to receive the lugs 152, 154 of the connector 100 when the connector 100 is mated with the plastic protection cap 300. The tapering wall portion 314 is located on each side of the cut out portion 315 and serves to align the lugs 152, 154 as the cap is inserted by an axial movement over the connector 100 of FIG. 1. As the plastic cap is inserted over the connector 100 the larger semi-circular ring portion of the connector fits around the smaller semi-circular portion of the plastic cap within a recess 352 and the smaller ring portion 124 fits inside of the larger ring portion 322 of the plastic cap in a recess 354 between the ring 322 and an internal body portion 360 of the plastic cap.

A latch 380 is mounted within the undercut portion 315 and will be described in greater detail in connection with later figures, FIGS. 4–7.

Figure 4:
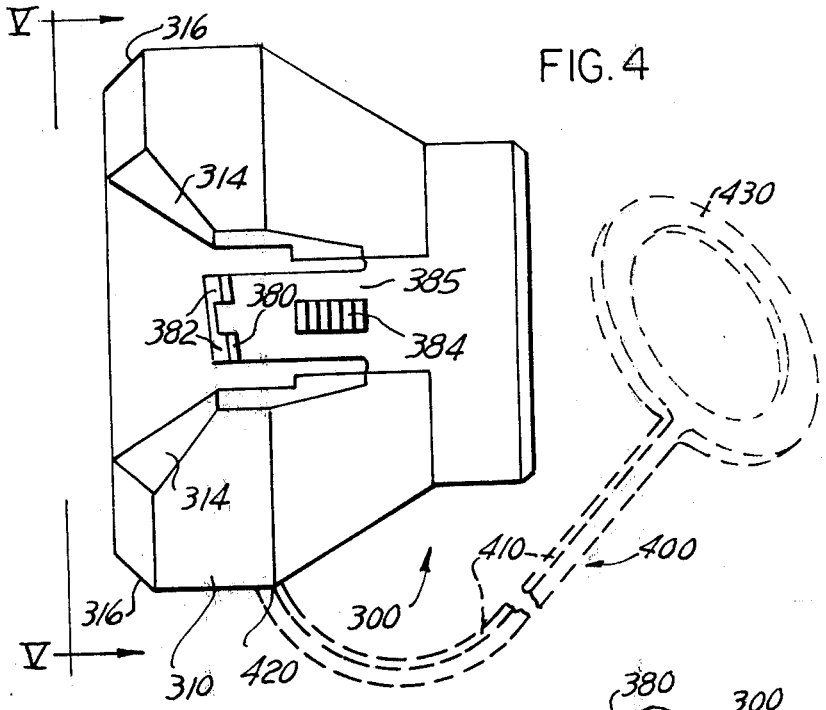
FIG. 4 is a side view of the protection cap of FIG. 3.

FIG. 4 is a side view of the molded cap 300 of FIG. 3. In this view, the body 310 is shown with the tapered entry 314 to the latch 380. The latch 380 includes a forward locking element 382 and a rear release 384. The entire latch 380 is movable radially inward by an operator's depressing the rear release 384. An adequate radial movement inward of the latch 380 releases the lug 152 of the connector 100 and allows the connector 100 and the cap 300 to be separated by relative axial movement.

Mating of the connector 100 and the cap 300 is accomplished by aligning the lug 152 with the latch 380 and aligning the smaller semicircular portion 124 of the connector with the larger semicircular portion 322 of the cap 300. An axial movement of the cap 300 toward the connector 100 causes the lug 152 to push the locking element 382 radially inward until the lip of the lug 152 is behind (rearwardly of) the locking element 382. When the lip of the lug is behind the locking element, the entire latch 380 returns to its original position to provide a positive lock of the cap 300 to the connector 100.

The cap 300 is advantageously molded from a polymeric material, which is preferably a Zytel-brand nylon plastic. Such a material allows the entire cap 300 to be molded as a single piece in an appropriate die and allows the latch 380 to be resiliently radially deformable to latch and release the lug, pivoting at a hinge 385, without breaking.

Additionally, the cap 300 may optionally be molded with an integral lanyard 400 for connecting the cap 300 to the cable assembly 10 and connector 100. The lanyard 400 includes a flexible cable 410 which has an attachment 420 to the body 310 at one end, a loop 420 at the other end. Since the lanyard 400 need not be included as an integral part, it is shown by dotted lines.

An annular outside forward edge 316 is provided with a tapering edge to provide a non-snag corner. A squared-off edge might catch on environmental elements.

FIG. 5 is a front view of the cap 300 showing the two semi-circular ring portions 322, 324, and the contact receiving cavities 330, 340. Also shown are the two latches 380, each with the locking element 382 and the release. The internal body portion 360 is provided with two recesses, which have been provided for molding purposes to minimize wall dimensions.

FIG. 6 is a cross sectional view taken along the line VI—VI in FIG. 5. The cap 300 is shown in solid lines, while the mating connector 100 is shown by dotted lines. The cap 300 includes the semicircular portions 322, 324 and contact receiving cavities 330, 340. An annular seal 372 is mounted within the cap and extends completely around and outside of the contact receiving cavities 330, 340, but within the semi-circular rings 322, 324. A second flat seal 374 is mounted within the cavity 330.

The forward portion of the cap 300 includes the annular tapered edge 316 for non-snap purposes.

The rear of the cap 300 includes a screw hole 390 for a self tapping screw (not shown) which would be an alternative attachment for a lanyard if the integral lanyard is not used. Additionally, an annular recess 392 is provided to reduce weight and wall thicknesses which are desirable for molding.

The connector 100 is shown by dotted lines with the two contacts 130, 140 shown (and the included pairs of terminals 132, 134 and 142, 144, respectively) which contacts are in the cavities 330, 340, respectively. The semicircular portions 122, 124 of the connector fit within appropriate recesses in the cap 300 and the lug 152 fits over the locking element 382, with a lip 154 of the lug 154 fitting behind the locking element 382 to secure the cap 300 and the connector 100.

FIG. 7 shows an enlargement of the latch 380 and the locking element 382 and release 384 which are movable from a released condition shown in solid lines and a locked condition shown in dotted lines. The lug 152 and its lip 154 are shown.

Figure 8:
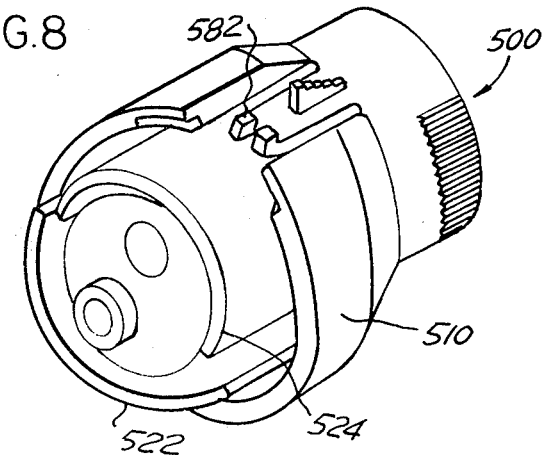
FIG. 8 is an alternate embodiment for the protection cap of FIG. 3.

FIG. 8 shows an alternate design for a molded plastic cap 500 for use in the assembly of the present invention. While the cap 500 includes cavities, latch elements 582, 584 and semicircular rings 522, 524 similar to the cap of FIG. 3, a body 510 does not extend as far forward (e.g., with respect to the semicircular rings 522, 524) as the FIG. 3 embodiment.

While a preferred embodiment of the present invention has been disclosed with some specificity, it should be appreciated that the foregoing embodiment is exemplary only which may be changed or modified to advantage. Further, some features of the present invention may be used to advantage without the use of other features. For example, a larger cap which surrounds the entire connector including the lugs could be used together with a similar latch. Additionally, other latch structures and moisture-proofing arrangements could be used. Additionally, in some applications, caps may not require the moisture resistance provided by gaskets. Accordingly, the foregoing description and the appended drawings should be considered as only illustrative of the principles of the invention and not to limit the scope thereof.

Having thus described the invention, what is claimed is:

1. An electrical connector assembly comprising a body including a pair of coaxial cables, each of which terminates in a two-terminal contact facing forward, said body including a forward projection and at least one lug extending radially spaced from the projection and axially forward from said body; and a molded cap of polymeric material for protecting the terminals, said cap including a recess for receiving the projection and a pair of cavities, each for receiving one of the contacts, said cap including an integral latch mounted on an external portion of the cap and being pivotally coupled thereto to allow resilient deflection between a first position to lock the lug against axial movement between the cap and the body and a second position in which the cap and the body are allowed to move axially.

2. An electrical connector assembly of the type described in claim 1 wherein the polymeric cap includes means for restricting moisture from entering the connector and cap assembly when mated.

3. An electrical connector assembly of the type described in claim 1 wherein the cap additionally includes a lanyard for coupling the cap to the connector body.

4. An electrical connector assembly of the type described in claim 3 wherein the lanyard is integrally molded with the cap.

5. An electrical connector assembly of the type described in claim 1 wherein the polymeric material of the cap is a nylon material.

* * * * *